United States Patent [19]

Felter

[11] 3,977,311

[45] Aug. 31, 1976

[54] LOUVER FAN ASSEMBLY

[76] Inventor: John V. Felter, 1309 Ashland, Houston, Tex. 77008

[22] Filed: Nov. 22, 1974

[21] Appl. No.: 526,122

[52] U.S. Cl. ..... 98/39; 98/43 R; 98/121 R; 415/209

[51] Int. Cl.[2] ..... F24F 13/06; F24F 7/06

[58] Field of Search ..... 98/8, 10, 13, 14, 32, 98/33 A, 33 R, 37, 39, 42, 43, 116, 121 R; 415/209

[56] References Cited

UNITED STATES PATENTS

| | | | |
|---|---|---|---|
| 1,794,447 | 3/1931 | DeBothezat | 415/209 |
| 1,906,408 | 5/1933 | Persons | 98/121 R |
| 2,382,075 | 8/1945 | Leslie | 98/121 R |
| 2,470,201 | 5/1949 | Werner | 98/42 |
| 2,710,717 | 6/1955 | Palmer | 98/121 R |
| 2,936,109 | 5/1960 | Copeland | 415/209 |

*Primary Examiner*—William E. Wayner
*Assistant Examiner*—Ronald C. Capossela
*Attorney, Agent, or Firm*—Carl B. Fox, Jr.

[57] ABSTRACT

Louver fan assembly including a housing for mounting a fan at an angle in line with the slats of the louver. The invention also provides an improved design of louver for use with the housing and fan.

9 Claims, 4 Drawing Figures

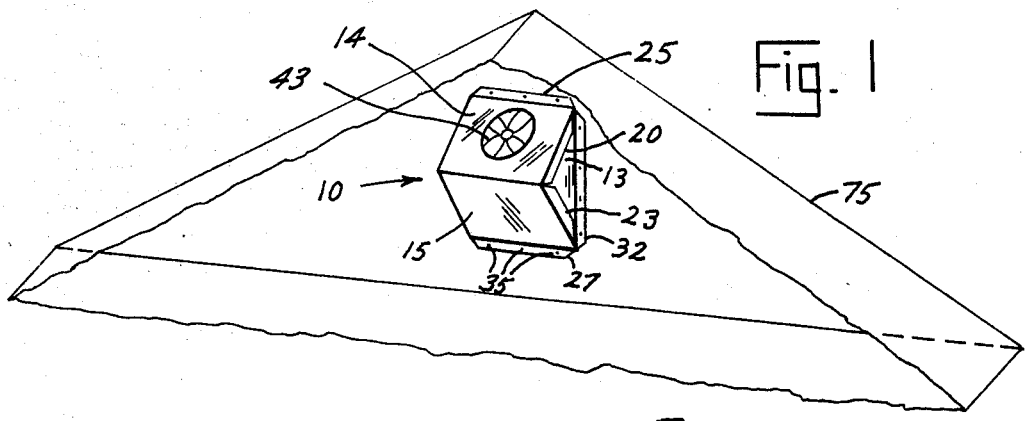
Fig. 1
Fig. 4
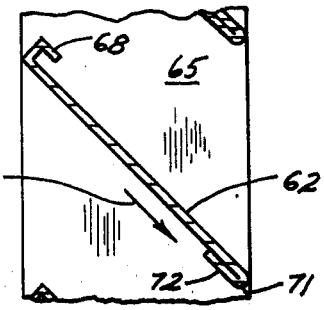
Fig. 2
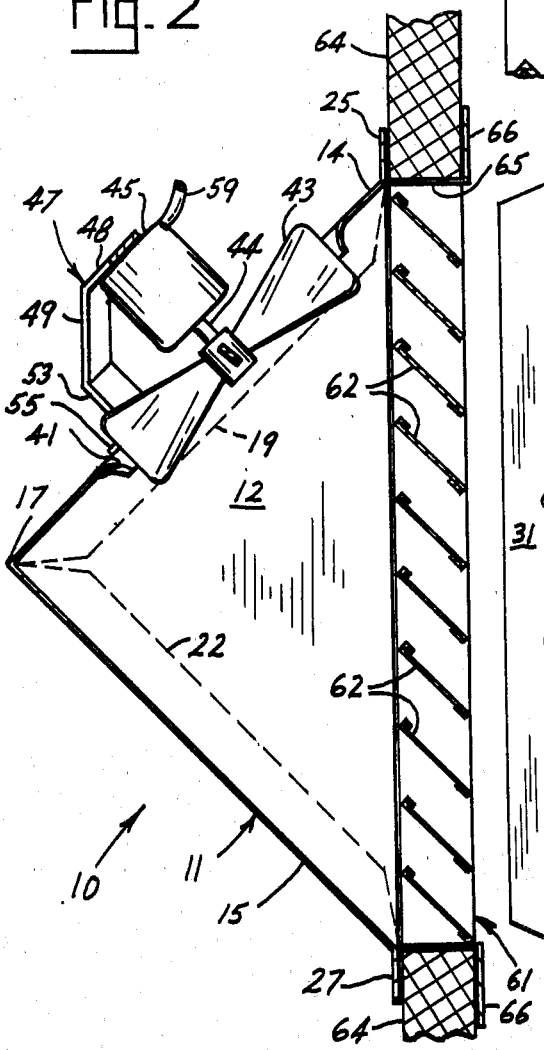
Fig. 3
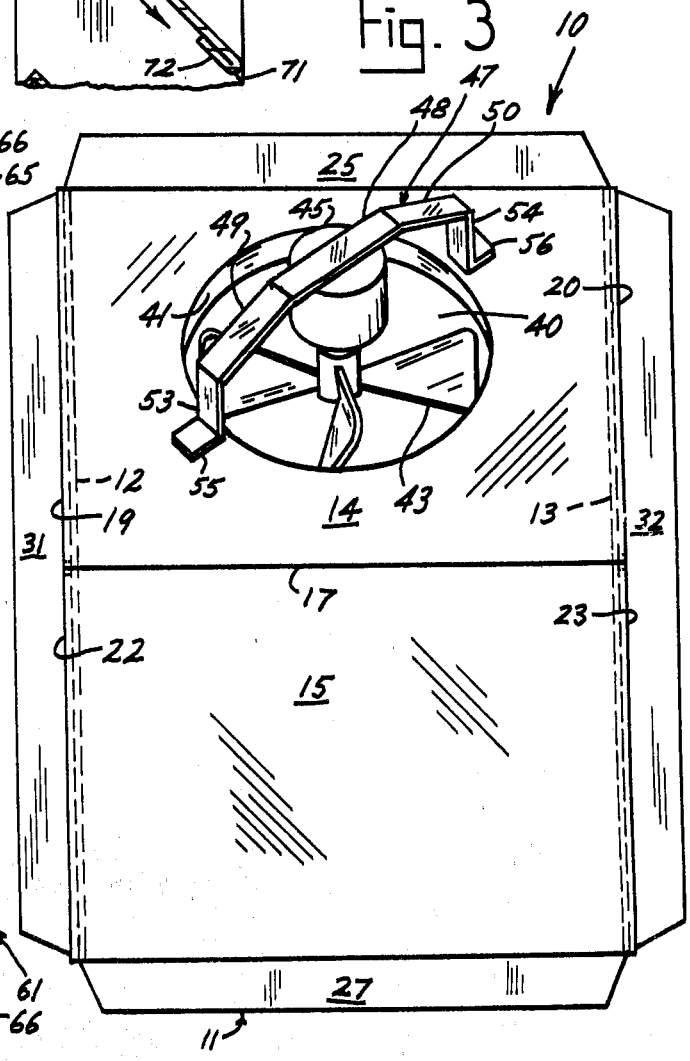

LOUVER FAN ASSEMBLY

BACKGROUND AND SUMMARY OF THE INVENTION

Buildings and houses are often provided with louvers through walls or gables of the building structure. Ventilation through such louvers is improved if a fan or blower is provided for increasing air flow therethrough. Fans for this purpose have been provided, but in every case the fans have been disposed to blow angularly against the slats of the louver whereby part of the effect of the fan is lost through friction, and noise results from the air hitting angularly against the slats of the louver.

This invention provides a substantial improvement over past louver fan designs. A housing is provided which mounts the fan or blower at an angle whereby the air flow through the louver is maximum and noise produced by the air flow is reduced. Furthermore, the design provides that air is withdrawn from the attic or other building interior from a relatively hot part thereof, whereby the ventilation is made more effective. The apparatus provided by the invention is suitable for use with existing louvers, and can also be provided in combination with newly installed louvers, and is fan-louver combinations. The louver design is improved whereby the louver slats maintain effective strength yet increased airflow may be achieved therepast.

A principal object of the invention is to provide a mounting housing for louver fans, and combinations of such housings and fans with louvers. Another object of the invention is to provide such apparatus wherein the fans are disposed to blow in line with the slats of a louver whereby air flow through the louver is increased and whereby sound produced by air flow through the louver is reduced. A further object of the invention is to provide such apparatus which is simple to install and use, yet which is entirely reliable. Still another object of the invention is to provide such apparatus which is economical.

Other objects and advantages of the invention will be perceived from the following descriptions of preferred embodiments, reference during the description being made to the accompanying drawings.

BRIEF DESCRIPTIONS OF THE DRAWINGS

FIG. 1 is a perspective view showing a preferred embodiment of apparatus according to the invention, and showing a preferred manner of installation of the apparatus in the gable of a building.

FIG. 2 is a vertical cross section of the apparatus shown in FIG. 1 and a louver in combination with which the apparatus is installed.

FIG. 3 is an elevation of the apparatus shown in FIGS. 1–2.

FIG. 4 is a partial enlarged vertical cross section of the louver shown in FIG. 2.

DESCRIPTION OF THE PREFERRED EMBODIMENT

Referring now to the drawings in detail, and first to FIGS. 1–3, the apparatus 10 includes a housing 11 of triangular cross section including triangular end walls 12, 13 and angular walls 14, 15. Walls 14 and 15 are, as shown, preferably made of a single sheet of metal bent at corner or apex 17. Wall 14 has perpendicular bevel ended flange 19 and 20, while wall 15 has perpendicular bevel ended flanges 22, 23. Wall 14 also has upper angular edge flange 25, and wall 15 has lower angular edge flange 27. The flanges 19, 20, 22, 23 are disposed flatly against the edges of walls 12, 13 and tack welded thereto (not shown) to assemble the housing, other suitable connections of the flanges to the walls 12, 13 being equally suitably used. Wall 12 has bevel ended side flange 31 and wall 13 has bevel ended side flange 32. The flanges 25, 27, 31 and 32 are used for connection of the housing to a wall or frame, the screws 35 indicated in FIG. 1 showing this connection.

The triangular sides or walls 12, 13 are shown to be of right angle shape at apex 17, and to have equal length sides or edges at walls or sides 14 or 15, but other triangular forms must be used.

Referring now to FIGS. 2 and 3, wall 14 has therethrough a circular opening 40 having an inwardly curved rim 41 therearound. Rim 41 is in the form of a venturi to smooth air passage through the fan opening. The fan 43 is mounted on shaft 44 of motor 45 which is carried by an angular bracket 47. The flat central part 48 of bracket 47 is bolted or otherwise suitably affixed to the end of electric motor 45, and angular bracket portions 49, 50 are bent angularly inwardly to perpendicular bracket portions 53, 54 and end flanges 55, 56. Electric motor 45 has suitable electrical connection 59 for supply of operating current, conductor 59 being connected or including a suitable switch for turning the fan on or off.

As will be noted, fan 43 is disposed closer to flange 25 than to apex 17 in order that the air flow created by the fan will strike approximately at the center of louver 61. The slats 62 of louver 61 are disposed angularly downwardly outwardly of the building, as is customarily.

Referring to FIGS. 2 and 4 of the drawings, the louver slats 62 are formed of sheet metal and are novel in shape. The slats 62 of louver 61, as customary, are slanted downwardly outwardly of the building. The louver is shown installed within an opening through a wall 64. Wall 64, as has been described, may be the gable wall of a house or other building structure, or may be any other wall of a building structure. The louver has a surrounding frame 65 having surrounding flange 66 for use in installing the louver in the wall opening, by driving screws or nails or other fasteners through flange 66. The slats of louvers, made of sheet metal, are customarily of open box form as at 68, FIG. 4, at both their upper and lower edges. The angular configuration 68 provides strength and rigidity for the louver slats so that they may not be easily bent or damaged. However, with the fan 43 providing increased air flow through the louver, the slats 62 according to the invention are of modified form. The formation 68 shown at the top of the louver slat is retained, but at the lower edge of the slat, the slat edge is simply hemmed as at 71 by bending and flattening a strip 72 as shown. This construction retains an essential amount of strength for the lower edge of the slat, but streamlines the slat form whereby air passing therepast in the direction of arrow 73 is not hindred in its flow to cause turbulance and noise. This stream-lining of the lower edges of the louvers increases the air output through the fan and louver and improves the ventilation provided by the apparatus.

As will be noted in FIG. 1, the outline of the gabled end of a building 75 is shown. This schematic showing indicates a more or less customary location of a louver in a home or other building, and indicates the positioning of the apparatus according to this invention over the louver. It will be noted that the fan 43 is disposed to draw air from within the attic at the upper peak portion of the attic, so that the hottest air is withdrawn from the attic. This improves the ventilation characteristics of the system.

The housing 11 including fan 43 may be provided as a separate unit or in combination with the louver 61. The housing and fan may be installed and used with an existing louver, or the complete fan, housing and louver may be supplied and installed together.

While preferred embodiments of the invention have been shown in the drawings and described, many modifications thereof may be made by a person skilled in the art without departing from the skill of the invention, and it is intended to protect by Letters Patent all forms of the invention falling within the scope of the following claims.

I claim:

1. Ventilation apparatus, comprising a housing having a fan mounting side facing the interior of said housing at a downward angle and having a vertical open side opposite said fan mounting side serving as an air outlet, connection means around said open side of said housing for use in connecting said open side of said housing to a wall having an air outlet therethrough surrounded by said connection means, said housing having a closed lower side extending from the lower edge of said fan mounting side angularly downwardly to the lower edge of said vertical open side, fan means supported at an opening through said fan mounting side of said housing disposed to impel air into said housing and toward said open side of said housing.

2. The combination of claim 1, said housing having two vertically disposed sides of triangular shape and two angular sides one of which comprises said fan mounting side and the other of which comprises said closed lower side, said triangular sides being disposed at opposite sides of said open side of said housing.

3. The combination of claim 2, said triangular sides of said housing being in the form of right triangles.

4. The combination of claim 3, said triangular sides of said housing each having two edges of substantially equal length.

5. The combination of claim 1, said air outlet through said wall comprising a louver having vanes parallel with said closed lower wall and in line with the air flow impelled by said fan means.

6. The combination of claim 5, said housing having two vertically disposed sides of triangular shape and two angular sides one of which comprises said fan mounting side and the other of which comprises said closed lower side, said triangular sides being disposed at opposite sides of said open side of said housing.

7. The combination of claim 6, said triangular sides of said housing being in the form of right triangles.

8. The combination of claim 7, said triangular sides of said housing each having two edges of substantially equal length.

9. The combination of claim 5, said vanes of said louver each being reinforced by an upper edge having a first edge strip formed transversely of the vane and a second edge strip formed parallely closely spaced from the vane, and said vanes of said louver each having a lower edge in line with the vane and flushly hemmed, said flushly hemmed lower edge of each vane permitting air flow smoothly therepast.

* * * * *